US012637778B2

(12) United States Patent
Ren et al.

(10) Patent No.: US 12,637,778 B2
(45) Date of Patent: May 26, 2026

(54) FAST AMBIENT-TEMPERATURE SYNTHESIS OF OER CATALYSTS FOR WATER ELECTROLYSIS

(71) Applicant: University of Houston System, Houston, TX (US)

(72) Inventors: Zhifeng Ren, Pearland, TX (US); Luo Yu, Houston, TX (US); Shuo Chen, Houston, TX (US)

(73) Assignee: UNIVERSITY OF HOUSTON SYSTEM, Houston, TX (US)

( * ) Notice: Subject to any disclaimer, the term of this patent is extended or adjusted under 35 U.S.C. 154(b) by 590 days.

(21) Appl. No.: 17/996,491

(22) PCT Filed: Apr. 26, 2021

(86) PCT No.: PCT/US2021/029109
§ 371 (c)(1),
(2) Date: Oct. 18, 2022

(87) PCT Pub. No.: WO2021/222077
PCT Pub. Date: Nov. 4, 2021

(65) Prior Publication Data

US 2023/0220570 A1 Jul. 13, 2023

Related U.S. Application Data

(60) Provisional application No. 63/016,490, filed on Apr. 28, 2020.

(51) Int. Cl.
*C25B 11/054* (2021.01)
*C25B 1/04* (2021.01)
(Continued)

(52) U.S. Cl.
CPC ..... *C25B 11/054* (2021.01); *C25B 1/04* (2013.01); *C25B 9/17* (2021.01); *C25B 11/031* (2021.01);
(Continued)

(58) Field of Classification Search
CPC ..... H01G 11/02; C25B 11/054
See application file for complete search history.

(56) References Cited

FOREIGN PATENT DOCUMENTS

CN 104659357 A 5/2015
CN 105970265 A 9/2016
(Continued)

OTHER PUBLICATIONS

Wang, Tanyuan, et al. "NiFe (Oxy) hydroxides derived from NiFe disulfides as an efficient oxygen evolution catalyst for rechargeable Zn-air batteries: the effect of surface S residues." Advanced Materials 30.27 (2018): 1800757. (Year: 2018).*
(Continued)

*Primary Examiner* — Dah-Wei D. Yuan
*Assistant Examiner* — Andrew J Bowman
(74) *Attorney, Agent, or Firm* — CONLEY ROSE, P.C.

(57) ABSTRACT

An aspect of the present disclosure provides time and energy-efficient synthesis of catalysts for water electrolysis. An exemplary synthesis method includes dissolving amounts of $Fe(NO_3)_3 \cdot 9H_2O$ and $Na_2S_2O_3 \cdot 5H_2O$ in deionized water at ambient temperature to form a solution, placing Ni foam into the solution where the Ni foam serves as a substrate and a Ni source for growth of sulfur-doped (Ni, Fe)OOH (S—(Ni,Fe)OOH) catalysts, leaving the Ni foam in the solution at ambient temperature for a duration between one minute and five minutes to provide a treated foam where the S—(Ni,Fe)OOH catalysts grow on the substrate during the duration, and removing the treated foam from the solution after the duration.

9 Claims, 13 Drawing Sheets

(51) Int. Cl.

| | |
|---|---|
| ***C25B 9/17*** | (2021.01) |
| ***C25B 11/031*** | (2021.01) |
| ***C25B 11/061*** | (2021.01) |
| ***C25B 11/091*** | (2021.01) |
| ***C25B 15/08*** | (2006.01) |

(52) U.S. Cl.
CPC ..... *C25B 11/061* (2021.01); *C25B 11/091* (2021.01); *C25B 15/08* (2013.01)

(56) References Cited

FOREIGN PATENT DOCUMENTS

| | | | | | |
|---|---|---|---|---|---|
| CN | 107335450 | A | | 11/2017 | |
| CN | 108842165 | A | | 11/2018 | |
| CN | 109652822 | A | | 4/2019 | |
| KR | 20190031035 | A | * | 3/2019 | ..... H01G 11/02 |
| WO | 2019/160701 | A1 | | 8/2019 | |

OTHER PUBLICATIONS

PCT/US2021/029109 International Search Report and Written Opinion dated Jul. 28, 2021 (8 p.).

Fang, Ming et al., "Hierarchical NiMo-Based 3D Electrocatalysts for Highly-Efficient Hydrogen Evolution in Alkaline Conditions," Nano Energy, vol. 27, pp. 247-254, Jul. 5, 2016 (8 p.).

Zhang, Xin et al., "A Simple Synthetic Strategy Toward Defect-Rich Porous Monolayer NiFe-Layered Double Hydroxide Nanosheets for Efficient Electrocatalytic Water Oxidation," Advanced Energy Materials, vol. 9, pp. 1-7, May 10, 2019 ( 8 p.).

Wu, Libo et al., "Recent Advances in Self-Supported Layered Double Hydroxides for Oxygen Evolution Reaction," AAAS Research, Article ID 3976278, pp. 1-17, Feb. 19, 2020 (17 p.).

Li, Yan et al., "Nickel-Molybdenum Nitride Nanoplate Electrocatalysts for Concurrent Electrolytic Hydrogen and Formate Productions," Nature Communications, vol. 10, pp. 1-12, Nov. 25, 2019 (13 p.).

Indian Examination Report dated Dec. 2, 2025, for Indian Application No. 2022170646 (9 p.).

Yang, Hongchao et al., "Green Synthesis of NiFe LDH/Ni Foam at Room Temperature for Highly Efficient Electrocatalytic Oxygen Evolution Reaction," Science China Materials, vol. 62, No. 5, pp. 681-689, 2019 (9 p.).

European Search Report dated Feb. 5, 2025, for European Application No. 21797741.2 (8 p.).

Fang, Ming et al., "Hierarchical NiMo-Based 3D Electrocatalysts for Highly-Efficient Hydrogen Evolution in Alkaline Conditions," Nano Energy, vol. 27, 2016, pp. 247-254 (8 p.).

* cited by examiner

Ni Foam
IrO2
S-(Ni,Fe)OOH
j (mA cm-2)
E (V vs. RHE)

Ni Foam: 104.6 mV dec-1
IrO2: 86.7 mV dec-1
S-(Ni,Fe)OOH: 48.9 mV dec-1
Overpotential (V)
log|j (mA m-2)|

1 min
2 min
3 min
5 min
j (mA cm-2)
E (V vs. RHE)

Ni Foam
1 min
2 min
3 min
5 min
-Im(Z) (Ω)
Re(Z) (Ω)

1 M KOH
1 M KOH+0.5 M NaCl
1 M KOH+1 M NaCl
1 M KOH+Seawater
j (mA cm-2)
E (V vs. RHE)

Cdl (mF cm-2)
2.75
8.25
12.2
21.6
28.2
Ni foam
1 min
2 min
3 min
5min

FAST AMBIENT-TEMPERATURE SYNTHESIS OF OER CATALYSTS FOR WATER ELECTROLYSIS

CROSS REFERENCE TO RELATED APPLICATIONS

This application is a 35 U.S.C. § 371 national stage application of PCT/US2021/029109 filed Apr. 26, 2021, and entitled "Fast Ambient-Temperature Synthesis of OER Catalysts for Water Electrolysis," which claims the benefit of and priority to U.S. Provisional Application No. 63/016,490, filed on Apr. 28, 2020, each of which is hereby incorporated by referenced herein in its entirety for all purposes.

TECHNICAL FIELD

The present disclosure relates to electrolysis of water, and more specifically, to fast ambient-temperature synthesis of catalysts for water electrolysis.

BACKGROUND

Water electrolysis is a sustainable and clean route to produce hydrogen ($H_2$) fuel, which is an important component of renewable-energy. Principally, water electrolysis includes two half-reactions: the hydrogen evolution reaction (HER) on the cathode and the oxygen evolution reaction (OER) on the anode. Compared with the HER process, OER is more sluggish because of the rigid O—O double bond and the multistep proton and electron transfer process, which hampers the overall efficiency of water electrolysis. There has been progress in developing efficient OER catalysts in order to decrease the OER overpotentials, including developing efficient OER catalysts that prevail over the benchmark of iridium and ruthenium dioxides ($IrO_2$ and $RuO_2$), which largely expedites the uphill water electrolysis process.

While there has been interest in developing efficient catalysts, little attention has been paid to energy and time costs of synthesizing the catalysts. For example, $MoNi_4/MoO_2$ is the most active HER catalyst reported and requires overpotentials of only 15 and ~70 mV at current densities of 10 and 500 mA $cm^{-2}$, respectively. However, synthesizing this catalyst entails a multistep procedure that is conducted over a long period of time at high temperatures and that even requires the consumption of high-purity $H_2$ gas, which is not economic for large-scale applications. The issue of high synthesis costs also applies to synthesis of many reported OER catalysts, which typically involves tedious multistep procedures under high temperature and requires significant time and energy consumption. Accordingly, the present disclosure considers OER catalyst efficiency as well as synthesis costs.

SUMMARY

Embodiments of the present disclosure are described in detail with reference to the drawings wherein like reference numerals identify similar or identical elements.

The present disclosure relates to fast ambient-temperature synthesis of OER catalysts for water electrolysis.

In aspects of the present disclosure, a method for ambient-temperature synthesis of catalysts for water electrolysis includes dissolving amounts of $Fe(NO_3)_3 \cdot 9H_2O$ and $Na_2S_2O_3 \cdot 5H_2O$ in deionized water at ambient temperature to form a solution, placing Ni foam into the solution where the Ni foam serves as a substrate and a Ni source for growth of sulfur-doped (Ni,Fe)OOH (S—(Ni,Fe)OOH) catalysts, leaving the Ni foam in the solution at ambient temperature for a duration between one minute and five minutes to provide a treated foam where the S—(Ni,Fe)OOH catalysts grow on the substrate during the duration, and removing the treated foam from the solution after the duration.

In various embodiments of the method, the method includes collecting the S—(Ni,Fe)OOH catalysts, and directly using the collected S—(Ni,Fe)OOH catalysts as oxygen evolution reaction (OER) electrodes.

In various embodiments of the method, the method includes etching a smooth surface of the Ni foam into nanoparticle layers with multiple levels of porosity.

In various embodiments of the method, surfaces of the treated foam include cracks having nanoparticles and having macropores that are less than ten micrometers in size. In various embodiments of the method, the nanoparticles are porous and have mesopores of about 20 nm-50 nm in size.

In various embodiments of the method, in the treated foam, sulfur exists on the surface of and in a lattice of the S—(Ni,Fe)OOH catalysts.

In various embodiments of the method, the method includes etching a surface of the Ni foam into a porous S—(Ni,Fe)OOH layer, the layer having $Ni(OH)_2$ and FeOOH and having sulfur residing on the surface and doped into a lattice of the layer. In various embodiments of the method, the S—(Ni,Fe)OOH layer is hydrophilic and contributes to release of gas bubbles during electrolysis.

In various embodiments of the method, dissolving amounts of $Fe(NO_3)_3.9H_2O$ and $Na_2S_2O_3.5H_2O$ in deionized water at ambient temperature includes dissolving 0.1x-0.5x grams of $Fe(NO_3)_3.9H_2O$ and 0.02x-0.3x grams of $Na_2S_2O_3.5H_2O$ in 10x mL of deionized water, for a value x.

In aspects of the present disclosure, a water electrolyzer includes an anode formed by a sulfur-doped (Ni,Fe)OOH (S—(Ni,Fe)OOH) electrode and a cathode formed by NiMoN nanowire arrays supported on Ni foam.

In various embodiments of the water electrolyzer, the water electrolyzer includes an alkaline natural seawater electrolyte.

In various embodiments of the water electrolyzer, a voltage of less than two volts between the anode and the cathode provides a current density of 1000 mA $cm^{-2}$. In various embodiments of the water electrolyzer, the voltage is approximately 1.951 volts.

In various embodiments of the water electrolyzer, a voltage between the anode and the cathode for providing a current density of 500 mA $cm^{-2}$ remains below 2 volts throughout one-hundred hours of continuous water electrolysis. In various embodiments of the water electrolyzer, the voltage for providing the current density of 500 mA $cm^{-2}$ changes by less than 1 mV per hour during the one-hundred hours of continuous water electrolysis.

In various embodiments of the water electrolyzer, the S—(Ni,Fe)OOH electrode is capable of delivering at least one of: a current density of 100 mA $cm^{-2}$ at an overpotential of 300 mV, a current density of 500 mA $cm^{-2}$ at an overpotential of 398 mV, or a current density of 1000 mA $cm^{-2}$ at an overpotential of 462 mV in alkaline seawater electrolyte.

BRIEF DESCRIPTION OF THE DRAWINGS

A better understanding of the features and advantages of the disclosed technology will be obtained by reference to the following detailed description that sets forth illustrative embodiments, in which the principles of the technology are utilized, and the accompanying drawings of which.

Figure 1:
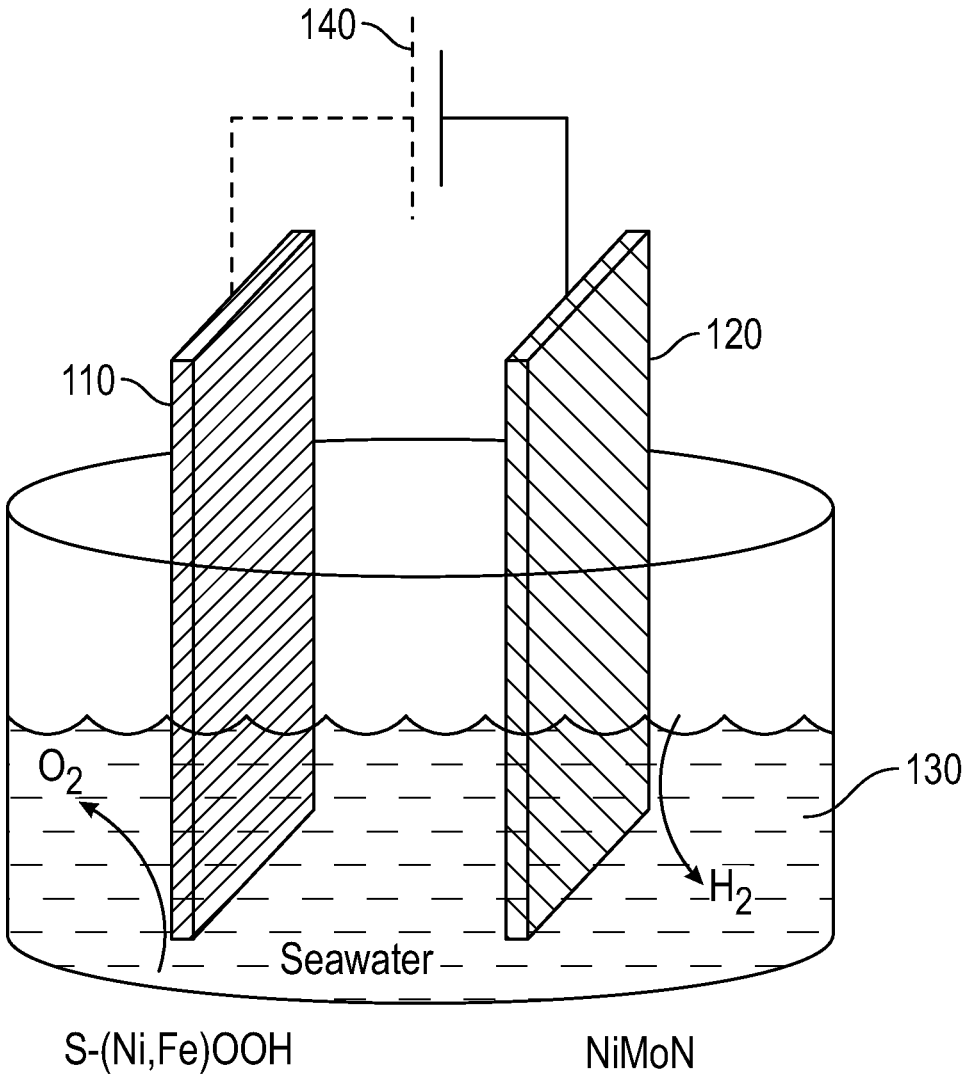
FIG. 1 is a diagram of an exemplary two-electrode electrolyzer for alkaline seawater electrolysis, in accordance with aspects of the present disclosure.

Further details and aspects of various embodiments of the present disclosure are described in more detail below with reference to the appended figures.

DETAILED DESCRIPTION

Although the present disclosure will be described in terms of specific embodiments, it will be readily apparent to those skilled in this art that various modifications, rearrangements, and substitutions may be made without departing from the spirit of the present disclosure.

For purposes of promoting an understanding of the principles of the present disclosure, reference will be made to exemplary embodiments illustrated in the drawings, and specific language will be used to describe the same. It will nevertheless be understood that no limitation of the scope of the present disclosure is thereby intended. Any alterations and further modifications of the features illustrated herein, and any additional applications of the principles of the present disclosure as illustrated herein, which would occur to one skilled in the relevant art and having possession of this disclosure, are to be considered within the scope of the present disclosure.

The present disclosure relates to fast ambient-temperature synthesis of OER catalysts for water electrolysis. Aspects of the present disclosure relate to a fast, cost-effective, and scalable method to synthesize NiFe-based (oxy)hydroxide catalysts at ambient temperature for high performance seawater electrolysis. Although aspects of the present disclosure will be described below with respect to seawater electrolysis, the aspects and embodiments described herein are applicable to fresh water and to water from sources other than natural seawater. All such applications of water electrolysis are contemplated to be within the scope of the present disclosure.

Generally, efficient catalysts for water electrolysis include transition-metal oxides, (oxy)hydroxides, selenides, phosphides, and nitrides. Among these catalysts, the transition-metal (oxy)hydroxides, and especially the NiFe-based (oxy) hydroxides, are the most efficient oxygen evolution reaction (OER) catalysts, and they are the catalytically active species generated from surface reconstruction on many types of oxygen-evolving materials.

There are various strategies to promote the OER activity of NiFe-based (oxy)hydroxide catalysts, including morphology design to expose more active sites, surface defect engineering to regulate the electronic structure, and integration with carbon materials to improve electron transfer. For example, NiFe (oxy)hydroxides derived from NiFe disulfides can be coupled with carbon nanotubes for efficient OER in alkaline media. This catalyst requires an overpotential of 190 mV at a current density of 10 mA $cm^{-2}$ and is one of the OER catalysts that reduce the overpotential needed for the current density of 10 mA $cm^{-2}$ to below 200 mV. As another example, a core-shell catalyst of NiFe alloy (core) and ultrathin amorphous NiFe oxyhydroxide (shell) nanowire arrays, exhibits OER activity with overpotentials of 248 and 258 mV required to achieve large current densities of 500 and 1000 mA $cm^{-2}$, respectively, and meets industrial criteria of large current densities ≥500 mA $cm^{-2}$ at overpotentials ≤300 mV. As persons skilled in the art will recognize, higher current density corresponds to higher hydrogen production rate. Therefore, such examples of efficient catalysts can significantly advance the development of water electrolysis for large-scale hydrogen production, if lower time and energy costs of synthesizing the catalysts can be implemented.

An abundant supply of water for electrolysis is seawater. Compared with splitting purified water, seawater electrolysis is an effort that has greater benefits because it can be used for both hydrogen generation and seawater desalination. However, seawater electrolysis is dependent on highly active and robust OER catalysts that can sustain seawater splitting without chloride corrosion and that can do so over a large range of salinity. As reactions occur, the salt concentration in the water increases and, therefore, the catalyst should have sufficient catalytic activity across a range of salinity.

As explained in more detail below, the present disclosure relates to NiFe-based (oxy)hydroxide catalysts for high-performance seawater electrolysis and provides cost-effective and facile methodologies to synthesize such catalysts at ambient temperatures. In summary, a one-step synthesis method is disclosed to fabricate highly porous, self-supported S-doped Ni/Fe (oxy)hydroxide (denoted herein as S—(Ni,Fe)OOH) catalysts from readily available Ni foam in one to five minutes at ambient temperature. This fast synthesis method operates to engineer the surface of Ni foam into a hydrophilic S-doped Ni/Fe (oxy)hydroxide layer, which exhibits multiple levels of porosity with a large surface area and numerous active sites. Unlike prior electrodeposition or hydrothermal methods that result in weak contact between the catalyst and the substrate, the Ni foam in the disclosed synthesis method is directly reacted with a solution and quickly etched to produce the Ni/Fe (oxy) hydroxide layer, which produces highly robust contact and strong bonds and contributes to rapid electron transfer and good stability. In addition, sulfur is introduced on the surface and in the lattice of the Ni/Fe (oxy)hydroxide during the reaction, which may tune the valence state of Ni/Fe and optimize the absorption energy of the OER intermediates, thus improving OER activity.

FIG. 1 shows an exemplary two-electrode electrolyzer for alkaline seawater electrolysis. In the illustrated configuration, a S-doped Ni/Fe (oxy)hydroxide catalyst is directly used as an OER electrode 110. This OER electrode is paired with a HER electrode 120 formed by a HER catalyst of NiMoN, in 1 M KOH plus seawater electrolyte 130. The illustrated two-electrode electrolyzer can achieve current densities of 500 and 1000 mA $cm^{-2}$ at voltages 140 of 1.837 V and 1.951 V, respectively, and exhibit very good durability.

Figure 2:
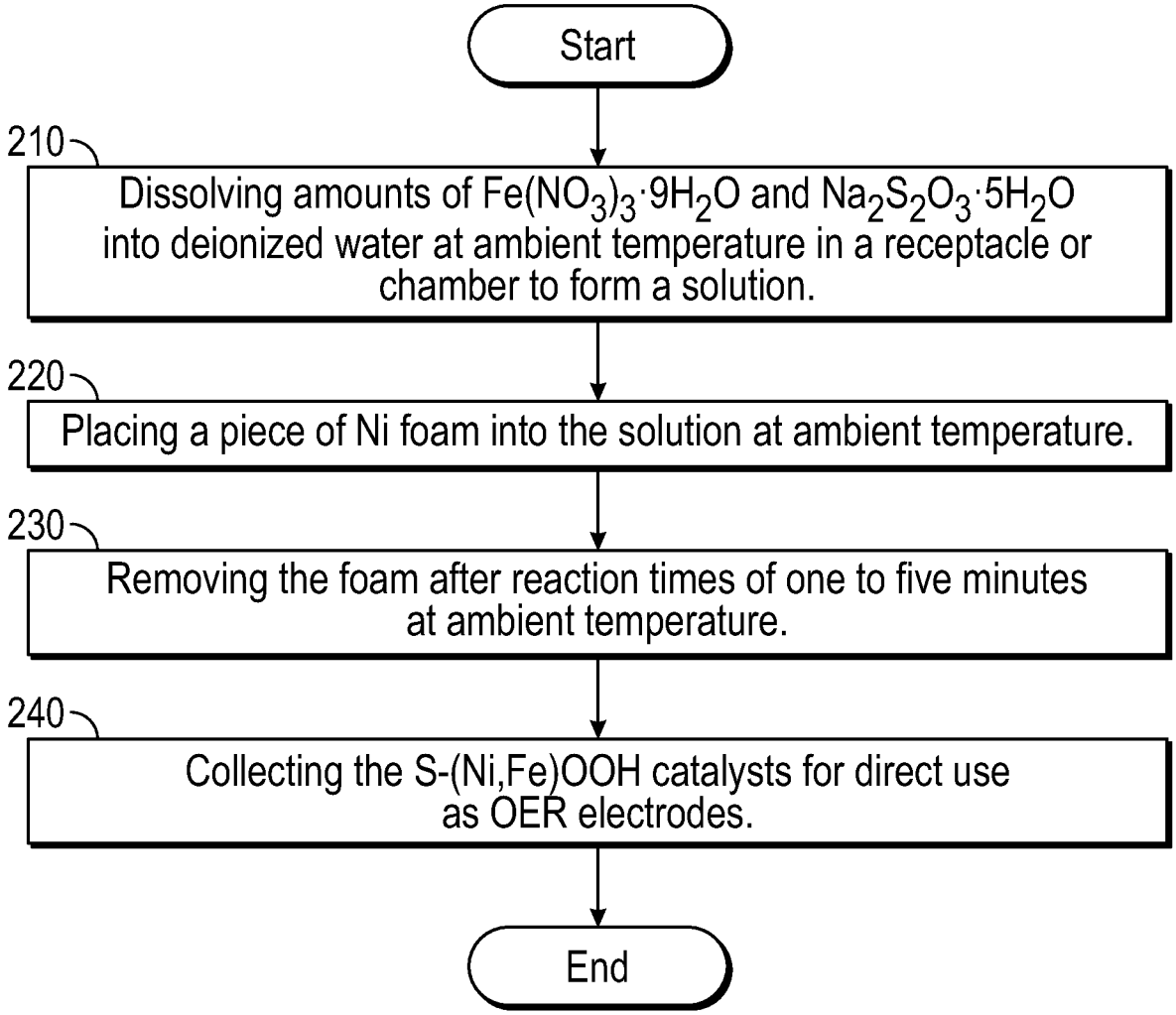
FIG. 2 is a flow diagram of an exemplary operation for synthesizing S—(Ni,Fe)OOH catalysts at ambient temperature, in accordance with aspects of the present disclosure.

FIG. 2 shows a flow diagram of an exemplary operation for synthesizing the S-doped Ni/Fe (oxy)hydroxide (S—(Ni, Fe)OOH) catalysts at ambient temperature. At block 210, the operation includes dissolving amounts of $Fe(NO_3)_3.9H_2O$ and $Na_2S_2O_3.5H_2O$ into deionized water at ambient temperature in a receptacle or chamber to form a solution. For example, 0.35 g $Fe(NO_3)_3.9H_2O$ and 0.05 g $Na_2S_2O_3.5H_2O$ can be dissolved into 10 mL deionized water in a glassy bottle. In various embodiments, the amounts can range from 0.1-0.5 grams of $Fe(NO_3)_3.9H_2O$ and 0.02-0.3 grams of $Na_2S_2O_3.5H_2O$, in 10 mL of deionized water. The amounts can be increased proportionally as the volume of deionized water is increased. Generally, for a value x, 0.1x-0.5x grams of $Fe(NO_3)_3.9H_2O$ and 0.02x-0.3x grams of $Na_2S_2O_3.5H_2O$ can be dissolved in 10x mL of deionized water. At block 220, the operation includes placing a piece of Ni foam into the solution at ambient temperature. For example, the piece of Ni foam can range from 1 cm×2 cm through 8 cm×10 cm, which corresponds to a single-side surface area of 2 $cm^2$ through 80 $cm^2$. Other sizes of Ni foam can also be used. Generally, continuing with the example above using the value x, a piece of Ni foam having single-side surface area between 2x $cm^2$ up to 80x $cm^2$ can be placed in the solution. Other sizes of Ni foam can be placed in the solution. The Ni foam serves as both the substrate and the Ni source for the growth of S—(Ni,Fe)OOH. At block 230, the operation includes removing the foam after reaction times of one to five minutes at ambient temperature. Generally, within that time range, the foam can be removed after a shorter duration when the amounts of $Fe(NO_3)_3.9H_2O$ and $Na_2S_2O_3.5H_2O$ are higher, and the foam can be removed after a longer duration when the amounts of such chemicals are lower. Optionally, the foam can be washed with deionized water after it is removed from the solution (not illustrated). At block 240, the operation involves collecting the S—(Ni,Fe) OOH catalysts for direct use as OER electrodes. The illustrated synthesis operation is fast (one to five minutes) and is conducted at ambient temperature, which makes the synthesis both time-efficient and energy-efficient. Moreover, the illustrated synthesis operation is scalable and, thus, is suitable for large-scale applications. As previous mentioned in connection with FIG. 1, when the resulting S—(Ni,Fe)OOH catalysts are directly used as OER electrodes in the exemplary seawater electrolyzer of FIG. 1, current densities of 500 and 1000 mA $cm^{-2}$ at voltages of 1.837 and 1.951 V, respectively, can be achieved for production of hydrogen, which satisfy industrial criteria.

FIG. 2 described an exemplary process of synthesizing the S—(Ni,Fe)OOH catalysts. The following paragraphs describe the characteristics and performance of the catalyst.

Figure 3:
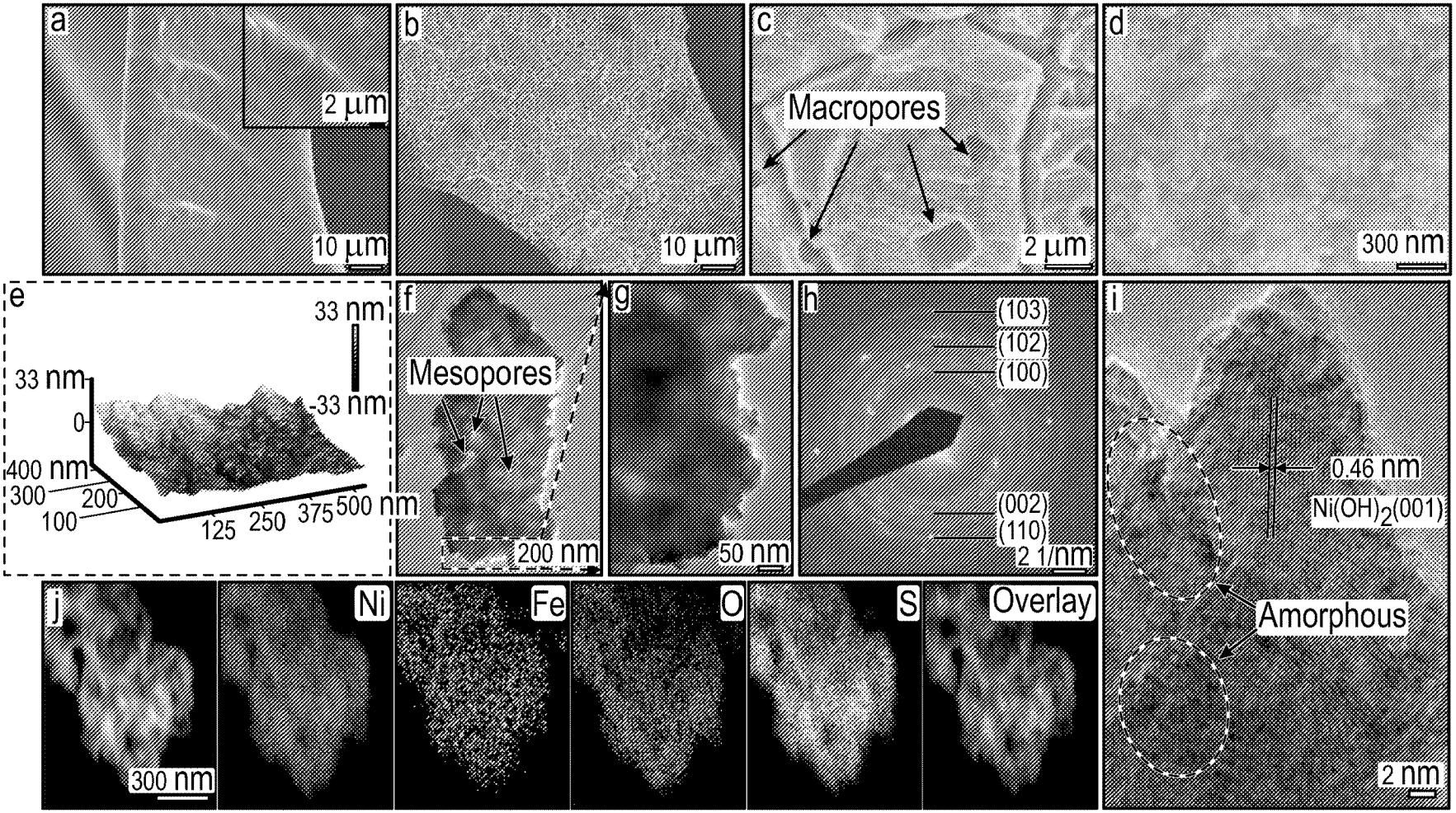
FIG. 3 is a diagram of images of exemplary surface morphology before and after a five-minute synthesis operation according to FIG. 2, in accordance with aspects of the present disclosure.
Figure 4A:
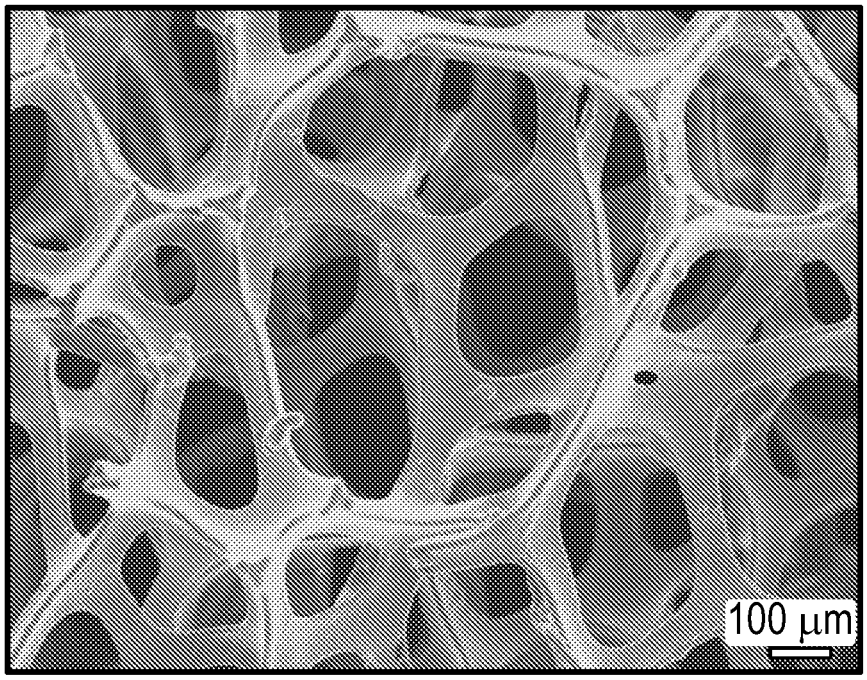
FIGS. 4A and 4B are diagrams of further images of exemplary surface morphology, in accordance with aspects of the present disclosure.
Figure 4B:
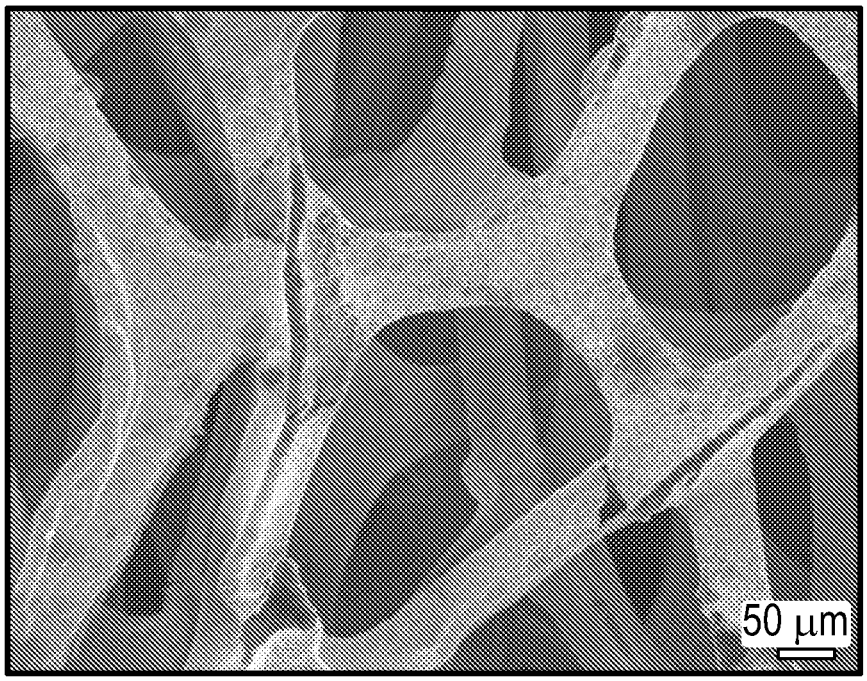

FIGS. 3, 4A, and 4B show images of exemplary surface morphology of the foam before and after the synthesis operation of FIG. 2. The surface morphology images were obtained by scanning electron microscopy (SEM), atomic force microscopy (AFM), and transmission electron microscopy (TEM). In FIG. 3, image (a) is SEM image of Ni foam, images (b)-(d) are SEM images of S—(Ni,Fe)OOH at different magnifications, image (e) is AFM image of 3D surface topography of S—(Ni,Fe)OOH on Ni foam, images (f) and (g) are TEM images, image (h) shows SAED pattern, image (i) is a high-resolution TEM image of S—(Ni,Fe)OOH, and image (j) shows a STEM image and corresponding elemental mapping of Ni, Fe, O, and S for S—(Ni,Fe)OOH.

Image (a) of FIG. 3 and FIG. 4A show that Ni foam before the synthesis operation is highly porous with pore sizes ranging from 100 to 800 μm, and its surface is largely smooth. After a five-minute reaction, the treated Ni foam retains its three-dimensional (3D) skeleton (FIG. 4B), but the surface has been etched into small parts separated by cracks (FIG. 3, image (b)). Low-magnification SEM images in images (c) and (d) of FIG. 3 reveal that the cracked parts are composed of nanoparticles and reveal that there are many macropores several micrometers in size (such as less than ten micrometers) generated on the surface, which may offer efficient channels for electrolyte diffusion. Image (e) of FIG. 3 displays the 3D surface topography of the S—(Ni, Fe)OOH on Ni foam measured by atomic force microscopy (AFM), showing an extremely rough surface with valley areas (dark) and tower areas (bright), which dramatically increases the accessible surface area. Transmission electron microscopy (TEM) images in images (f) and (g) of FIG. 3 further reveal that the S—(Ni,Fe)OOH nanoparticles are highly porous with plenty of mesopores (20~50 nm in size). Therefore, the synthesis method of FIG. 2 effectuates a surface engineering method that promptly etches the smooth surface of Ni foam into nanoparticle layers with multiple levels of porosity, thus providing more exposed active sites as well as promoting the release of oxygen bubbles from the catalyst surface, both of which are beneficial to the OER process, especially under large current densities. The selected area electron diffraction (SAED) pattern in image (h) of FIG. 3 shows well-defined diffraction rings, which are indexed to the (100), (002), (102), (110), and (103) planes of $Ni(OH)_2$. From the high-resolution TEM (HRTEM) image of S—(Ni,Fe)OOH in image (i), it can be seen that the nanoparticle includes both crystalline and amorphous parts, generating rich crystalline-amorphous boundaries, which may provide more catalytically active sites for OER catalysis. The clear lattice fringe with an interplanar spacing of 0.46 nm in the crystalline part is assigned to the (001) plane of $Ni(OH)_2$. Image (j) of FIG. 3 shows the scanning TEM (STEM) and corresponding energy dispersive X-ray spectroscopy (EDS) elemental mapping images of S—(Ni,Fe) OOH, providing further evidence of the porous nanostructure and confirming the existence and generally uniform distribution of elemental Ni, Fe, O, and S in the nanoparticles.

Figure 5:
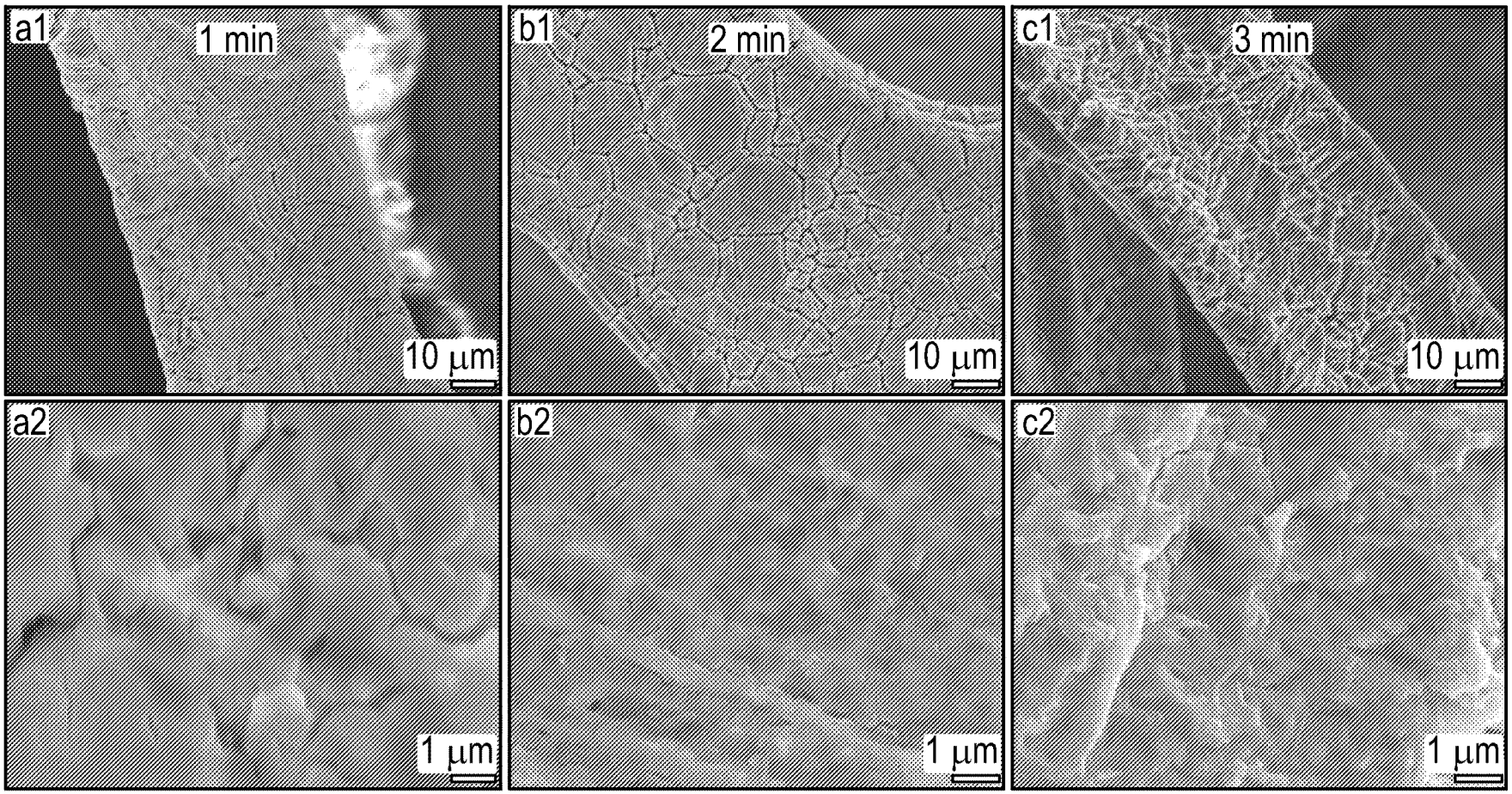
FIG. 5 is a diagram of further images of exemplary surface morphology for varying durations of synthesis operation according to FIG. 2, in accordance with aspects of the present disclosure.

FIG. 5 shows SEM images of the S—(Ni,Fe)OOH electrodes prepared using reaction times of one, two, and three minutes. Images (a1) and (a2) are SEM images of S—(Ni,Fe)OOH electrodes prepared using one-minute reaction times, images (b1) and (b2) are SEM images of S—(Ni,Fe)OOH electrodes prepared using two-minute reaction times, and images (c1) and (c2) are SEM images of S—(Ni,Fe)OOH electrodes prepared using three-minute reaction times. These images show that the Ni-foam surface is quickly etched and becomes increasingly rough with increasing reaction time until many macropores are created in the 5-minute reaction (FIGS. 3, 4A, and 4B).

In the synthesis operation of FIG. 2, reaction times longer than five minutes may cause the foam to become fragile with insufficient mechanical strength. The following paragraphs describe the result of five minutes of reaction time, unless indicated otherwise.

Figure 6A:
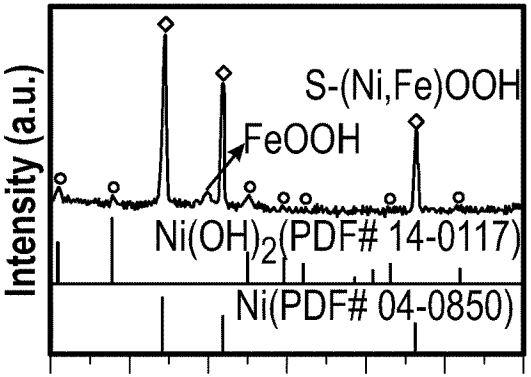
FIGS. 6A-6F are diagrams of exemplary X-ray diffraction (XRD) pattern of S—(Ni,Fe)OOH and X-ray photoelectron spectroscopy (XPS) measurements, in accordance with aspects of the present disclosure.
Figure 6B:
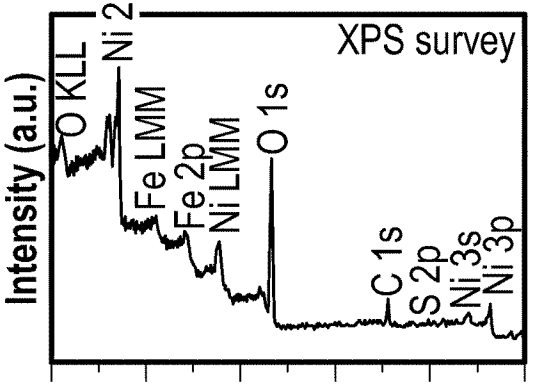
Figure 6C:
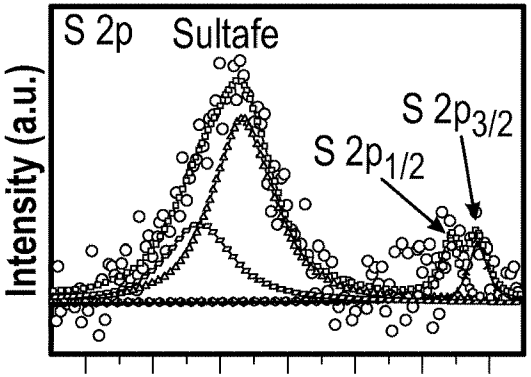
Figure 6D:
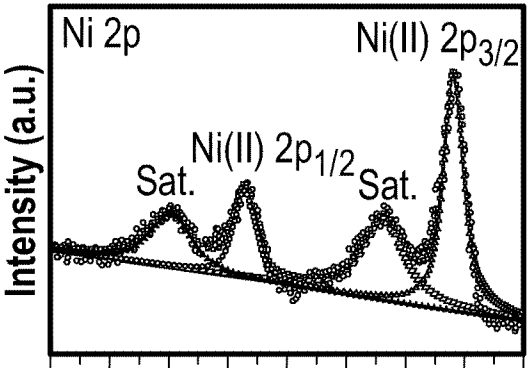
Figure 6E:
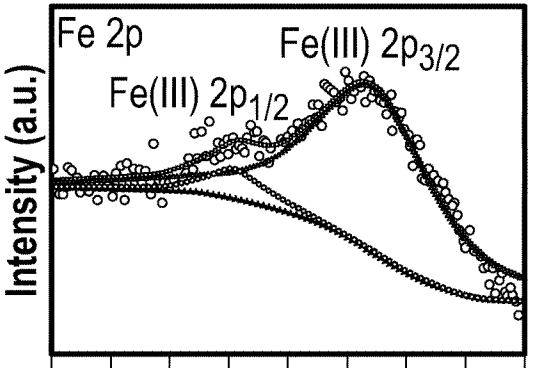
Figure 6F:
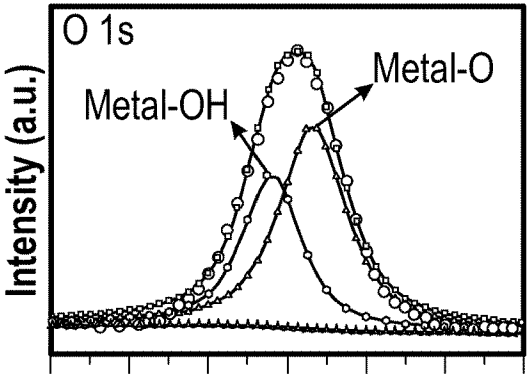

FIGS. 6A-6F show exemplary X-ray diffraction (XRD) pattern of S—(Ni,Fe)OOH and X-ray photoelectron spectroscopy (XPS) measurements. FIG. 6A is a XRD pattern, FIG. 6B is a XPS survey, FIG. 6C is a high-resolution XPS spectra of S 2p, FIG. 6D is a high-resolution XPS spectra of Ni 2p, FIG. 6E is a high-resolution XPS spectra of Fe 2p, and FIG. 6F is a high-resolution XPS spectra of O 1s, for S—(Ni,Fe)OOH.

In FIG. 6A, XRD is used to identify the crystal phase of the treated Ni foam. As shown FIG. 6A, except for the three strong diffraction peaks resulting from the Ni substrate, other peaks are well indexed to $Ni(OH)_2$ (XRD card number PDF #14-0117), and the peak at 49.8° is assigned to FeOOH (XRD card number PDF #76-2301).

FIGS. 6B-6F show X-ray photoelectron spectroscopy (XPS) measurements to investigate the chemical states of each element in the S—(Ni,Fe)OOH catalyst. In FIG. 6B, the XPS survey spectrum verifies the presence of elemental Ni, Fe, O, and S in the S—(Ni,Fe)OOH layer following the surface engineering of the Ni foam. FIG. 6C further shows the high-resolution XPS spectrum of S 2p, in which the two peaks located at 169.3 and 170.6 eV are originated from the residual sulfate groups, and the two small peaks at 162.3 and 163.1 eV correspond to S $2p_{3/2}$ and S $2p_{1/2}$ of $S^{2-}$, respectively, demonstrating that S exists both on the surface and in the lattice of S—(Ni,Fe)OOH. The introduced S may reduce the adsorption free energy difference between O* and OH* intermediates on the active sites, which is conducive to the OER activity. The high-resolution XPS spectrum of Ni 2p (FIG. 6D) shows two spin-orbit peaks at 855.8 (Ni $2p_{3/2}$) and 873.5 eV (Ni $2p_{1/2}$), along with two satellite peaks (identified as "Sat."), which are characteristic of the $Ni^{2+}$ oxidation state. In FIG. 6E, the Fe 2p XPS spectrum displays two peaks at 713.1 eV for Fe $2p_{3/2}$ and 724.3 eV for Fe $2p_{1/2}$, indicating the presence of the $Fe^{3+}$ oxidation state. For the O1s XPS spectrum displayed in FIG. 6F, the two peaks at 531.3 and 532.4 eV are attributed to metal-O and metal-OH, respectively. Therefore, the fast synthesis of FIG. 2 effectively etches the Ni foam surface into a highly porous S—(Ni,Fe)OOH layer, which is composed of $Ni(OH)_2$ and a small amount of FeOOH, along with S residing on the surface and doped into the lattice.

Figures 7A, 7B, 7C, 7D, 7E, 7F:
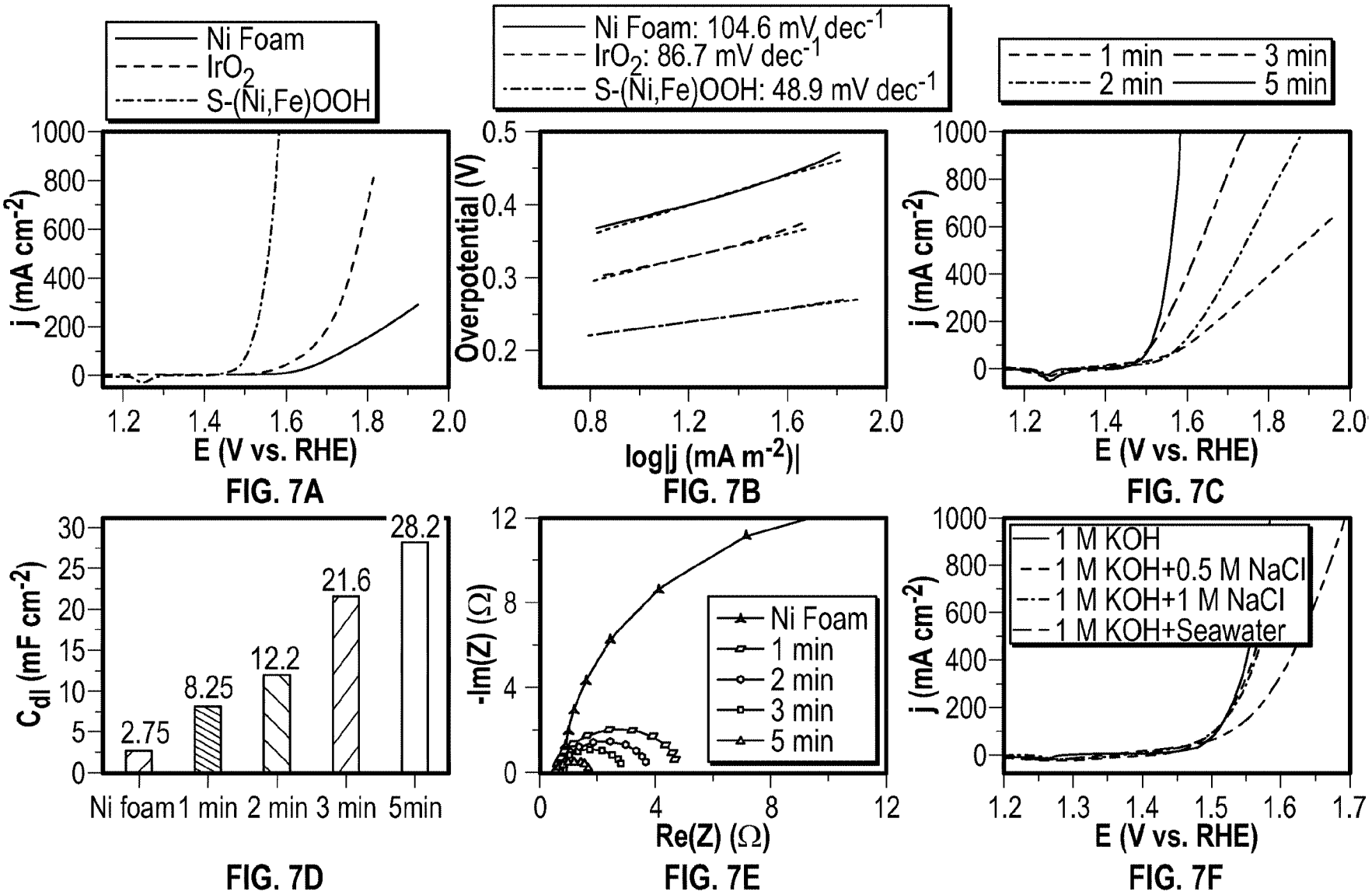
FIGS. 7A-7H are diagrams of graphs relating to exemplary electrocatalytic OER performance of the catalyst in different electrolytes, in accordance with aspects of the present disclosure.
Figure 7G:
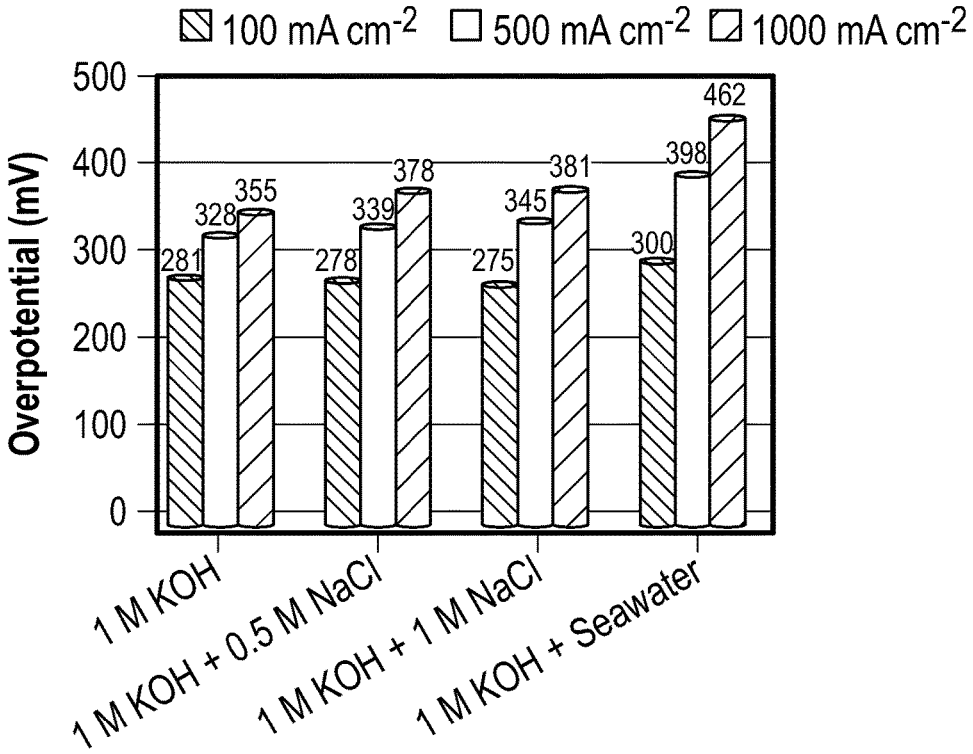
Figure 7H:
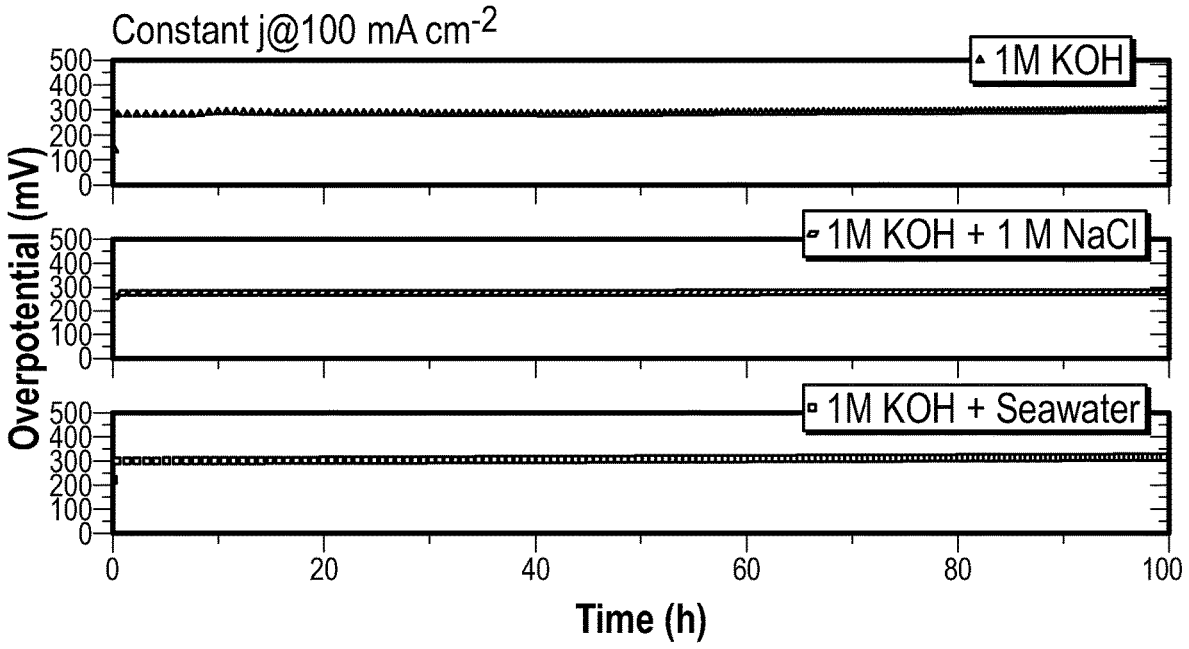

FIGS. 7A-7H show graphs relating to electrocatalytic performance of the catalyst synthesized according to FIG. 2. The performance was assessed by the OER activity of the as-prepared catalysts in 1 M KOH freshwater electrolyte, which was also used for commercial $IrO_2$ powder loaded on Ni foam as a benchmark for comparison. FIG. 7A shows polarization curves and FIG. 7B shows corresponding Tafel plots of the Ni foam, $IrO_2$, and S—(Ni,Fe)OOH electrodes. FIGS. 7C-7E show polarization curves, Cal values, and EIS Nyquist plots, respectively, of the S—(Ni,Fe)OOH electrodes prepared using different reaction times. FIG. 7F shows polarization curves and FIG. 7G shows comparison of the overpotentials required to achieve current densities of 100, 500, and 1000 mA $cm^{-2}$ for the S—(Ni,Fe)OOH electrode tested in different electrolytes. FIG. 7H shows long-term stability tests at a constant current density of 100 mA $cm^{-2}$ for the S—(Ni,Fe)OOH electrode in different electrolytes.

From the OER polarization curves displayed in FIG. 7A, it can be seen that, compared with commercial Ni foam, the S—(Ni,Fe)OOH electrode shows a significant enhancement for OER, and it is also superior to the benchmark of $IrO_2$. To deliver current densities of 10 and 100 mA $cm^{-2}$, the required overpotentials for the S—(Ni,Fe)OOH electrode are below 300 mV at 229 mV and 281 mV, respectively, which are much lower than that of commercial Ni foam (382 and 512 mV) and $IrO_2$ (313 and 430 mV). At the overpotential of 350 mV, the S—(Ni,Fe)OOH electrode exhibits a large current density up to 930 mA $cm^{-2}$, which is about thirty-one times that of the benchmark $IrO_2$ catalyst, demonstrating very desirable OER activity. In addition, the S—(Ni,Fe)OOH electrode exhibits a smaller Tafel slope of 48.9 mV $dec^{-1}$ (FIG. 7B) compared with that of Ni foam (104.6 mV $dec^{-1}$) and $IrO_2$ (86.7 mV $dec^{-1}$), suggesting more rapid OER catalytic kinetics.

As shown by FIGS. 7A and 7B, the OER performance of the S—(Ni,Fe)OOH electrode outperforms most other transition-metal (oxy)hydroxide catalysts as well as many non-noble metal catalysts. The synthesis process for the S—(Ni,Fe)OOH catalyst is much more efficient in terms of energy and time than that for any of the other reported OER catalysts, indicating that the synthesis operation of FIG. 2 can efficiently product large-size samples with low energy consumption. Furthermore, the self-supported S—(Ni,Fe)OOH catalyst can be directly utilized as an OER electrode, thus avoiding the use of an expensive polymer binder to immobilize active materials on the substrates, which further simplifies the procedure and lowers the cost for electrode preparation.

Referring to FIGS. 7C and 7D, OER activity is characterized for the S—(Ni,Fe)OOH electrodes prepared using different reaction times in 1 M KOH freshwater electrolyte. Longer reaction time leads to higher OER activity, and the five-minute reaction is the best among the four reaction times. This is because the Ni foam surface becomes more etched with increasing reaction time as shown in FIG. 5, contributing to a rougher and more porous surface with more active sites, which was verified by determination of the electrochemically active surface area (ECSA) through the calculation of double-layer capacitance ($C_{dl}$) from cyclic voltammetry (CV) curves. As shown in FIG. 7D, the $C_{dl}$ value increases with increasing etching time. The five-minute S—(Ni,Fe)OOH foam has a $C_{dl}$ value of 28.2 mF $cm^{-2}$, which is 1.31, 2.31, and 3.42 times that of the 3-, 2-, and 1-minute S—(Ni,Fe)OOH foams, respectively, and more than ten times that of commercial Ni foam (2.75 mF $cm^{-2}$), suggesting a larger ECSA with a higher density of exposed active sites. This indicates further modifying the Ni foam with smaller pores is beneficial to larger surface areas. Additionally, compared with the hydrophobic surface of Ni foam, the S—(Ni,Fe)OOH layer exhibits a favorable hydrophilic feature, which not only benefits electrolyte diffusion but also contributes to the fast release of gas bubbles. This is another reason for the promoted OER activity of the S—(Ni,Fe)OOH catalyst, especially under large current densities. Electrochemical impedance spectroscopy (EIS) Nyquist plots in FIG. 7E further show that the S—(Ni,Fe)OOH catalysts have smaller charge-transfer resistance ($R_{ct}$) in comparison with commercial Ni foam, and the five-minute reaction foam exhibits the smallest $R_{ct}$ value of 1.2Ω, demonstrating good electronic conductivity and efficient electron-transport capability.

Referring to FIGS. 7F and 7G, the graphs show evaluation of the OER performance of the S—(Ni,Fe)OOH catalyst in alkaline simulated seawater (1 M KOH plus 0.5 M NaCl and 1 M KOH plus 1 M NaCl) and alkaline natural seawater (1 M KOH plus seawater) electrolytes. As shown in FIG. 7F, the OER activity of the S—(Ni,Fe)OOH catalyst remains more than acceptable in the 1 M KOH plus 0.5 M NaCl electrolyte, requiring overpotentials of 278, 339, and 378 mV to yield current densities of 100, 500, and 1000 mA $cm^{-2}$, respectively (FIG. 7G). Even in highly salinity (1 M KOH plus 1 M NaCl), the activity shows no significant degradation, and the catalyst's performance in either of these electrolytes is very close to that in 1M KOH. In the alkaline natural seawater electrolyte (1 M KOH plus seawater), the S—(Ni,Fe)OOH catalyst exhibits some activity decay due to the formation of insoluble precipitates on the electrode surface, which bury some active sites. In this situation, the S—(Ni,Fe)OOH catalyst still delivers current densities of 100, 500, and 1000 mA $cm^{-2}$ at overpotentials of 300, 398, and 462 mV, respectively (FIG. 7G). This performance is superior to that of most previously reported non-precious metal OER catalysts in alkaline salty water electrolyte, including superior to the performance of the highly efficient NiFe layer double hydroxide (LDH) OER catalyst.

FIG. 7H shows electrochemical stability of the catalyst. The stability of the S—(Ni,Fe)OOH catalyst is evaluated by performing long-term stability tests under a constant current density of 100 mA $cm^{-2}$ in different electrolytes. As shown in FIG. 7H, the real-time potential remains highly stable with negligible increase throughout one-hundred hours of continuous operation in either the alkaline highly salty water or the natural seawater electrolyte, demonstrating OER durability, which mainly originates from the robust contact between the S—(Ni,Fe)OOH layer and the Ni foam, as well as the highly porous nanostructure with a good hydrophilic feature.

Figure 8:
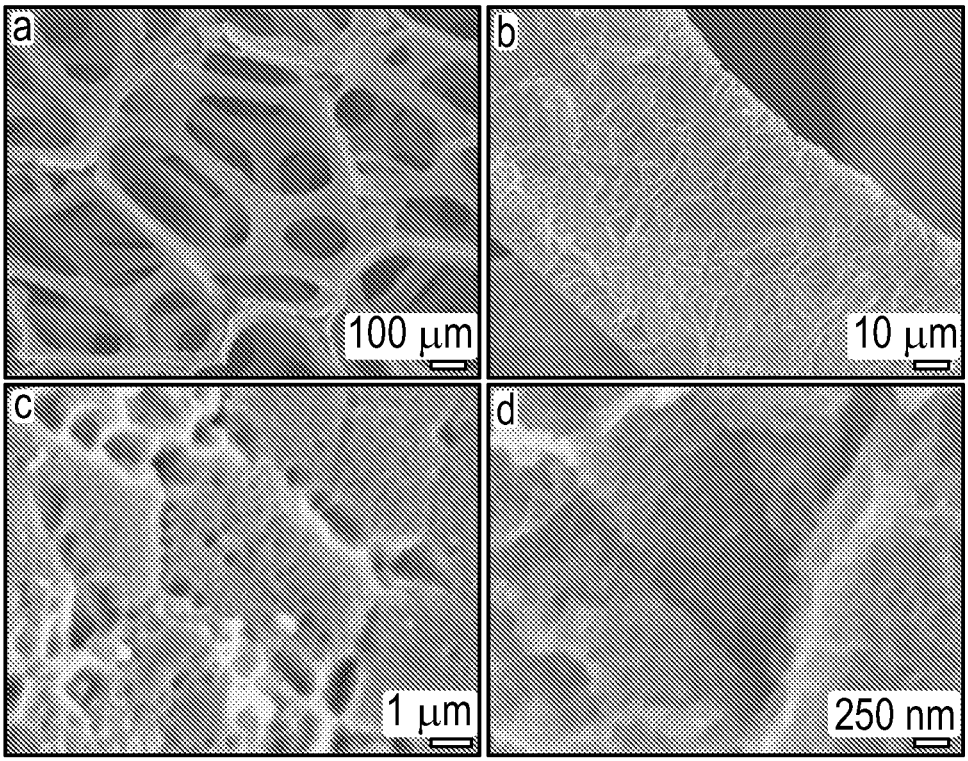
FIG. 8 is a diagram of exemplary surface morphology and nanostructure of the catalyst after OER stability test in seawater electrolyte, in accordance with aspects of the present disclosure.
Figure 9:
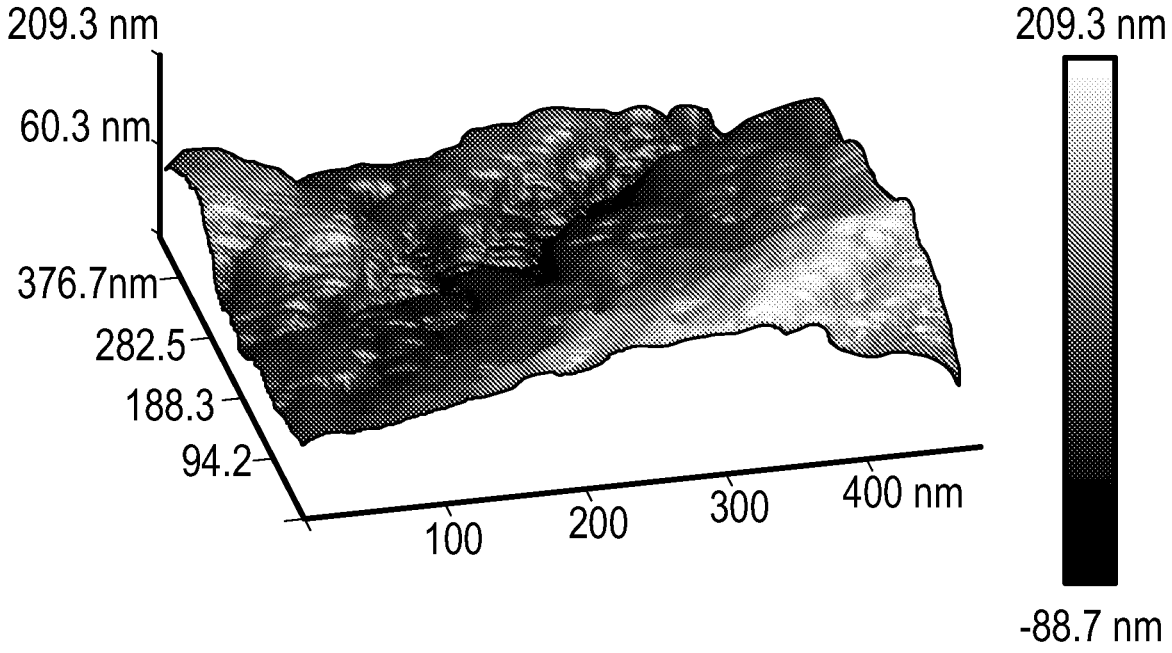
FIG. 9 is a further diagram of exemplary 3D surface topography of the catalyst after OER stability test in seawater electrolyte, in accordance with aspects of the present disclosure.
Figure 10:
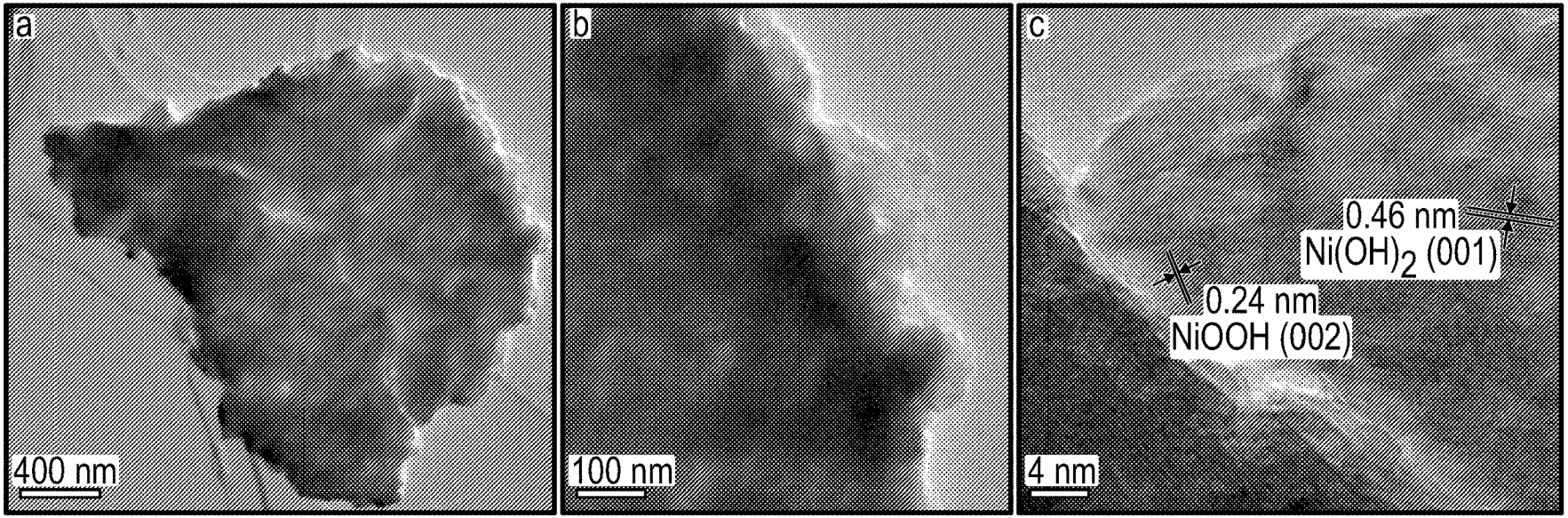
FIG. 10 is another diagram of exemplary surface morphology and nanostructure of the catalyst after OER stability test in seawater electrolyte, in accordance with aspects of the present disclosure.

FIGS. 8-10 show surface morphology and nanostructure of the S—(Ni,Fe)OOH catalyst after stability testing in 1 M KOH plus seawater electrolyte. FIG. 8 shows SEM images of S—(Ni,Fe)OOH at low and high magnifications after OER stability testing in 1 M KOH plus seawater. FIG. 9 shows an AFM image of surface topography of S—(Ni,Fe)OOH on Ni foam after OER stability testing in 1 M KOH plus seawater. FIG. 8 and FIG. 9 show that the 3D rough and porous nanostructures of the S—(Ni,Fe)OOH catalyst are well preserved after long-term stability testing. FIG. 10 shows TEM images of S—(Ni,Fe)OOH after OER stability testing in 1 M KOH plus seawater, and these also show the presence of porous nanoparticles after stability testing, attesting to the catalyst's structural stability. Notably, from the high resolution TEM image shown in image (c) of FIG. 10, the lattice fringes from the (001) plane of $Ni(OH)_2$ can be detected, as shown in image (i) of FIG. 3, as well as some newly generated lattice fringes from the (002) plane of NiOOH. The generated NiOOH species is mostly derived from the oxidation of $Ni(OH)_2$ during the OER process, which was further confirmed by high-resolution XPS results obtained before and after OER stability testing, as shown in FIG. 11.

Figure 11A:
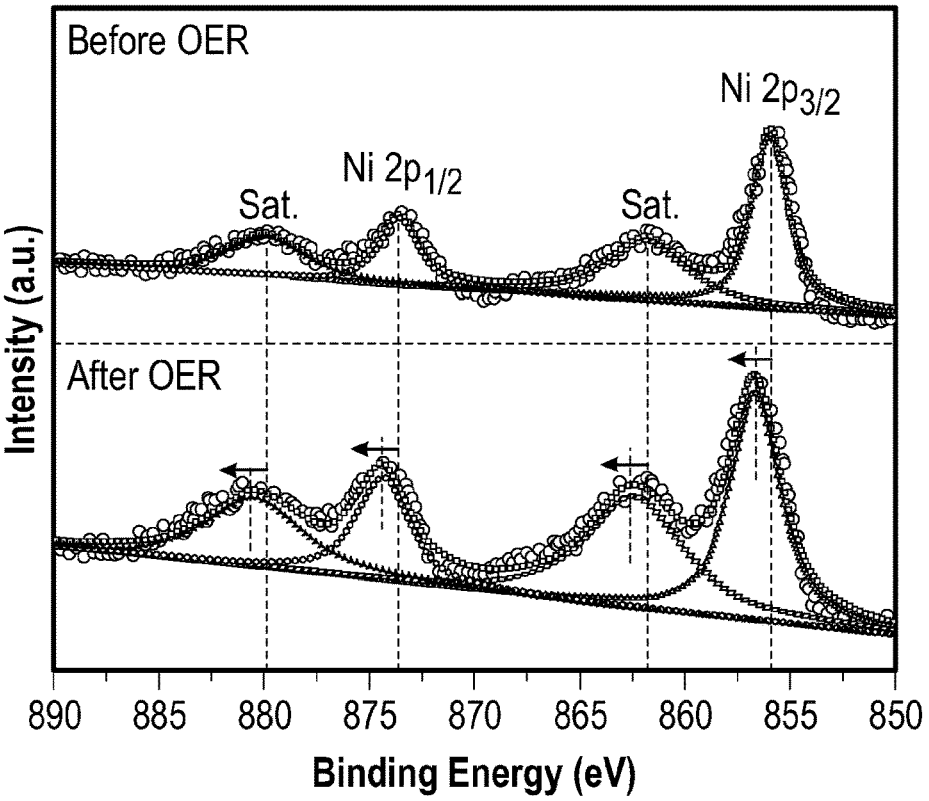
FIGS. 11A-11B are diagrams of exemplary high-resolution XPS spectra after OER stability test in seawater electrolyte, in accordance with aspects of the present disclosure.
Figure 11B:
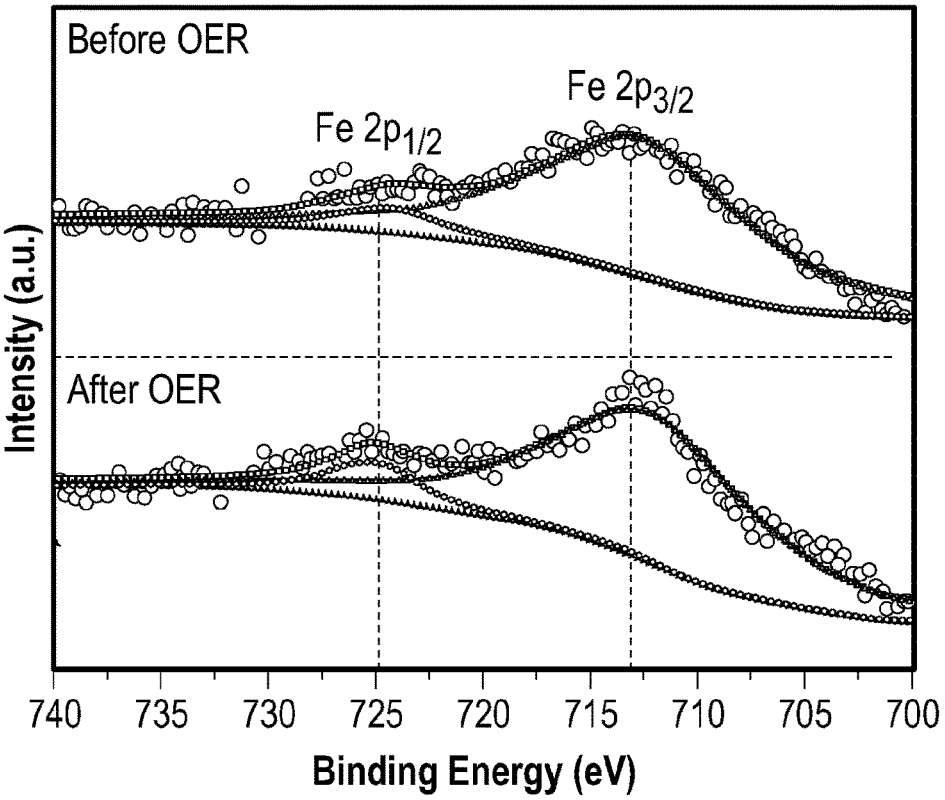

FIG. 11A shows high-resolution XPS spectra of Ni 2p, and FIG. 11B shows high-resolution XPS spectra of Fe 2p, for S—(Ni,Fe)OOH before and after OER stability testing in 1 M KOH plus seawater. As shown in the high-resolution XPS spectra of Ni 2p in FIG. 11A, all four peaks shift toward higher binding energy after OER testing, indicating the oxidation of $Ni^{2+}$ to the higher valence state of $Ni^{3+}$, which is due to the transformation of $Ni(OH)_2$ into NiOOH during the OER process. There is no significant change in the Fe 2p XPS spectra after OER testing, as shown in FIG. 11B, indicating the stable presence of FeOOH during the OER process. Therefore, the real active species of the S—(Ni,Fe)OOH catalyst during the OER process should be NiOOH and FeOOH.

The above electrochemical tests demonstrate that the S—(Ni,Fe)OOH catalyst is active and stable for OER in both the freshwater and seawater electrolytes. The performance can be mainly attributed to the following aspects: (1) the highly porous S—(Ni,Fe)OOH layer has multiple levels of porosity, which provides a large surface area and a high density of active sites for the catalytic reaction; (2) the hydrophilic S—(Ni,Fe)OOH layer with pores of different sizes contributes to efficient electrolyte diffusion and the fast release of gas bubbles, both of which are crucial to achieve large current density; (3) the introduced S on the surface and in the lattice of S—(Ni,Fe)OOH may decrease the adsorption free energy difference between the O* and OH* intermediates, thus accelerating the OER process; and (4) directly etching the commercial Ni foam into the S—(Ni,Fe)OOH layer guarantees strong adhesion between the active material and the substrate, which not only reduces the contact resistance for rapid charge transfer, but also promotes mechanical and electrocatalytic stability.

Accordingly, an exemplary method of synthesizing the S—(Ni,Fe)OOH catalysts has been described, and the characteristics and performance of the catalyst have also been described. The following will describe the performance of the two-electrode electrolyzer of FIG. 1. The performance graphs are shown in FIGS. 12A-12D.

Figure 12A:
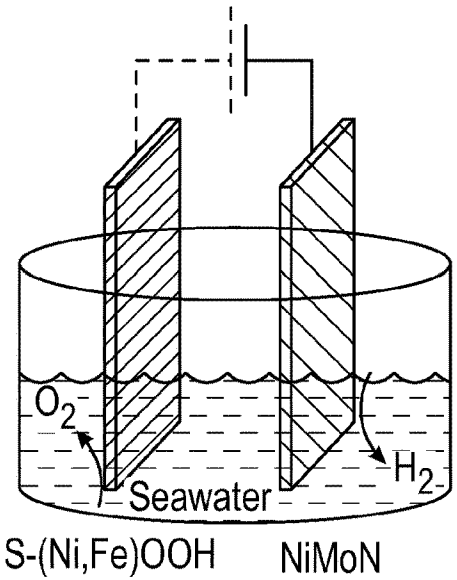
FIGS. 12A-12D are diagrams of exemplary overall seawater splitting performance graphs for the electrolyzer of FIG. 1, in accordance with aspects of the present disclosure.
Figure 12C:
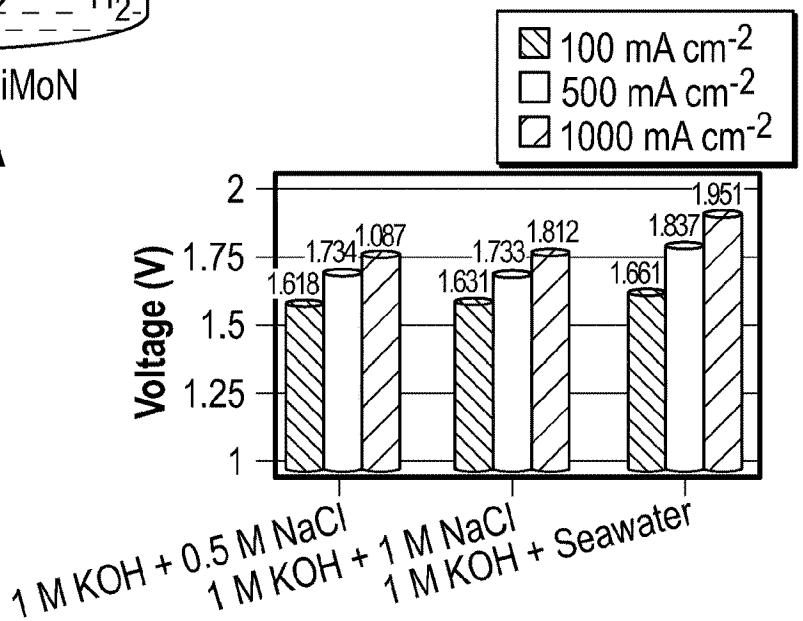
Figure 12B:
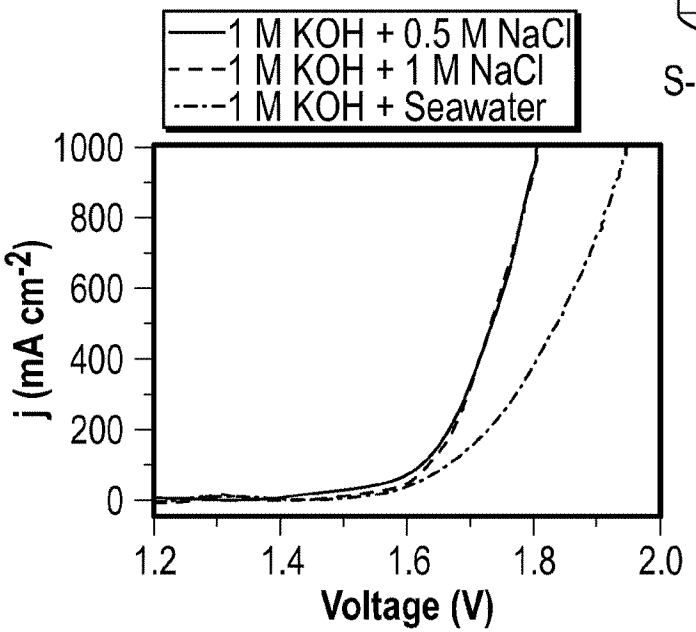
Figure 12D:
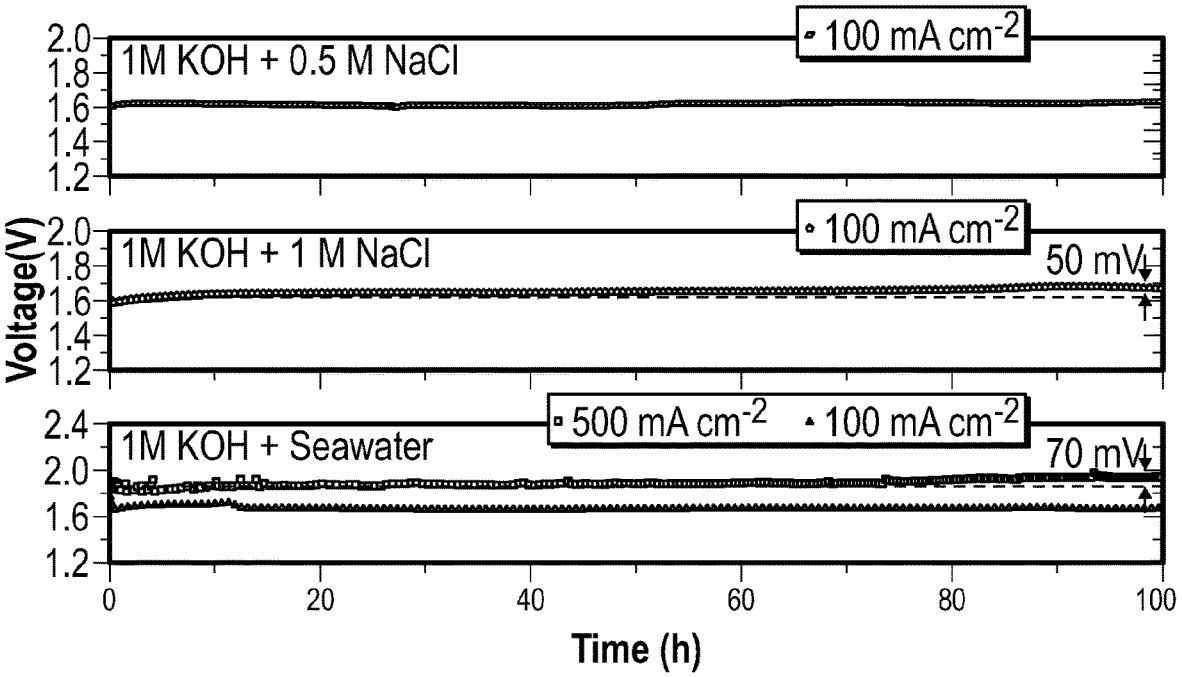

In the configuration of FIG. 1, which is also shown in FIG. 12A, the S—(Ni,Fe)OOH electrode (anode) is coupled with a HER catalyst of NiMoN nanowire arrays supported on Ni foam (cathode). FIG. 12B shows polarization curves and FIG. 12C shows comparison of the required voltages at current densities of 100, 500, and 1000 mA $cm^{-2}$ for the NiMoN and S—(Ni,Fe)OOH electrolyzer in different electrolytes. FIG. 12D shows long-term stability tests conducted at constant current densities of 100 and 500 mA $cm^{-2}$ in different electrolytes.

As shown in FIG. 12B, the electrolyzer of FIG. 1 exhibits desirable activity for overall seawater splitting in the two alkaline simulated seawater electrolytes. In 1 M KOH plus 1 M NaCl, current densities of 100, 500, and 1000 mA $cm^{-2}$ are achieved at voltages of 1.631, 1.733, and 1.812 V, respectively, at ambient temperature (FIG. 12C), which are even lower than the coupled benchmarks of $IrO_2$/Pt in 1 M KOH electrolyte. In the alkaline natural seawater electrolyte (1 M KOH plus seawater), the activity is slightly worse but is still more than acceptable (FIG. 12B). As shown in FIG. 12C, to deliver current densities of 100 and 500 mA $cm^{-2}$, the required voltages are 1.661 and 1.837 V, respectively. Even at a large current density of 1000 mA $cm^{-2}$, the corresponding voltage is only 1.951 V. Thus, the corresponding voltage is less than 2 V. This performance is better than that of many previously reported alkaline electrolyzers in 1 M KOH electrolyte, such as $Ni_3N$—VN with $Ni_2P$—VP2, NiMo with NiFe LDH, NiFeP with $NiFeO_x$, and the bifunctional-catalyst-based electrolyzers of $MoS_2$—$NiS_2$/N-doped graphene foam and NiFeRu LDH.

Figure 13:
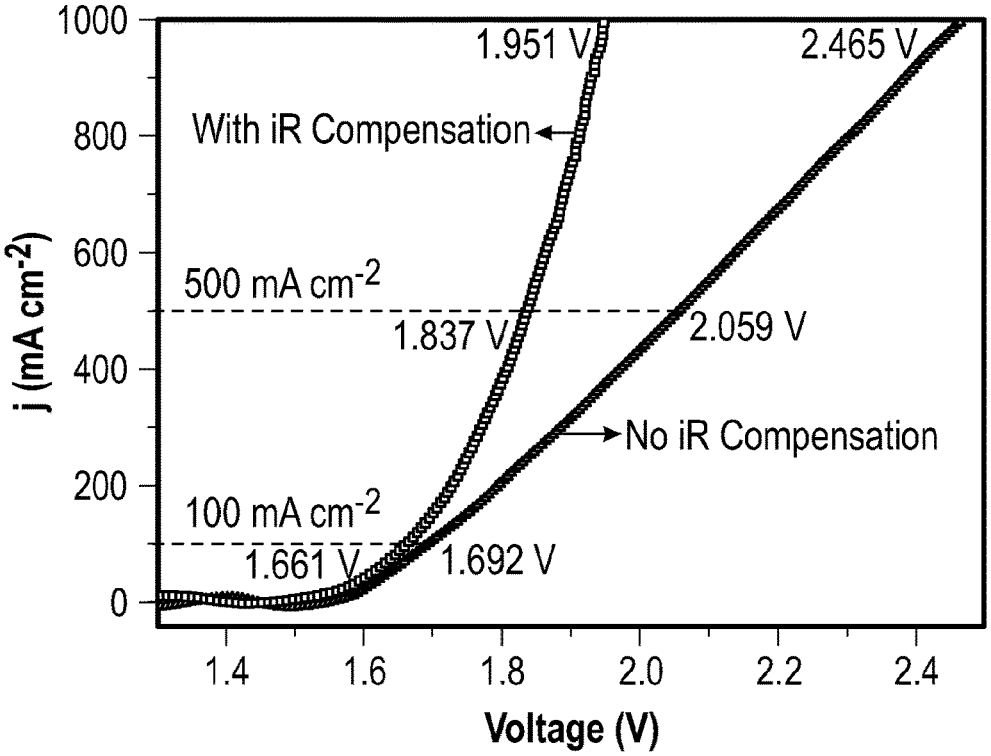
FIG. 13 is a diagram of exemplary performance for the electrolyzer of FIG. 1 with and without iR compensation, in accordance with aspects of the present disclosure.

Seawater electrolysis was also conducted in 1M KOH plus seawater at ambient temperature without iR compensation for comparison. FIG. 13 shows polarization curves of S—(Ni,Fe)OOH with NiMoN for overall seawater splitting with and without iR compensation in 1 M KOH plus seawater at ambient temperature. The graph of FIG. 13 indicates inferior performance without iR compensation compared to that with iR compensation. However, the electrolyzer of FIG. 1 also demonstrates very desirable durability. Under a constant current density of 100 mA $cm^{-2}$, the measured voltages keep highly stable in both 1 M KOH plus 0.5 M NaCl and 1 M KOH plus seawater electrolytes (FIG. 12D). In the highly salty water electrolyte (1 M KOH plus 1 M NaCl), the voltage displays a slight increase of 50 mV after 100 h operation. FIG. 12D also illustrates stability at a large current density of 500 mA $cm^{-2}$ in 1 M KOH plus seawater electrolyte. As shown in FIG. 12D, the voltage shows only a slight increase of ~70 mV after 100 h electrolysis and remains under 2 V, for a low degradation rate of 0.7 mV $h^{-1}$ (less than 1 mV $h^{-2}$), which is mainly due to the large adsorption of bubbles blocking some active sites. Overall, the electrolyzer of FIG. 1 has very desirable activity and stability, showing great potential for rapid hydrogen production through seawater electrolysis.

Accordingly, a cost-effective and industrially compatible method to convert readily available Ni foam into robust OER catalysts for high-performance seawater electrolysis has been described above. Benefiting from the advantages of a large surface area with a high density of active sites, a hydrophilic feature for electrolyte diffusion, a small charge-transfer resistance, and the fast release of gas bubbles, the synthesized S—(Ni,Fe)OOH catalyst exhibits very desirable OER performance with low overpotentials of 300 and 398 mV required to achieve current densities of 100 and 500 mA $cm^{-2}$, respectively, in alkaline natural seawater electrolyte. An efficient alkaline electrolyzer is disclosed by pairing the OER catalyst with a good HER catalyst, achieving current densities of 500 and 1000 mA $cm^{-2}$ at low voltages of 1.837 and 1.951 V, respectively. The low cost of the disclosed synthesis method, as well as the desirable performance of the resulting catalyst, advances the development of the hydrogen economy and of industrial seawater desalination.

Certain embodiments of the present disclosure may include some, all, or none of the above advantages and/or one or more other advantages readily apparent to those skilled in the art from the drawings, descriptions, and claims included herein. Moreover, while specific advantages have been enumerated above, the various embodiments of the present disclosure may include all, some, or none of the enumerated advantages and/or other advantages not specifically enumerated above.

The phrases "in an embodiment," "in embodiments," "in various embodiments," "in some embodiments," or "in other embodiments" may each refer to one or more of the same or different embodiments in accordance with the present disclosure. The phrases "in an aspect," "in aspects," "in various aspects," "in some aspects," or "in other aspects" may each refer to one or more of the same or different aspects in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A method for ambient-temperature synthesis of catalysts for water electrolysis, the method comprising:

dissolving amounts of $Fe(NO_3)_3 \cdot 9H_2O$ and $Na_2S_2O_3 \cdot 5H_2O$ in deionized water at ambient temperature to form a solution;

placing Ni foam into the solution, the Ni foam serving as a substrate and a Ni source for growth of sulfur-doped (Ni, Fe)OOH (S—(Ni,Fe)OOH) catalysts;

leaving the Ni foam in the solution at ambient temperature for a duration between one minute and five minutes to provide a treated foam, the S—(Ni, Fe)OOH catalysts growing on the substrate during the duration; and removing the treated foam from the solution after the duration.

2. The method according to claim 1, further comprising:

collecting the S—(Ni, Fe)OOH catalysts; and directly using the collected S—(Ni, Fe)OOH catalysts as oxygen evolution reaction (OER) electrodes.

3. The method according to claim 1, further comprising etching a smooth surface of the Ni foam into nanoparticle layers with multiple levels of porosity.

4. The method according to claim 3, wherein surfaces of the treated foam include cracks having nanoparticles and having macropores that are less than ten micrometers in size.

5. The method according to claim 4, wherein the nanoparticles are porous and have mesopores of about 20 nm-50 nm in size.

6. The method according to claim 1, wherein in the treated foam, sulfur exists on the surface of and in a lattice of the S—(Ni, Fe)OOH catalysts.

7. The method according to claim 1, further comprising etching a surface of the Ni foam into a porous S—(Ni, Fe)OOH layer, the layer having $Ni(OH)_2$ and FeOOH and having sulfur residing on the surface and doped into a lattice of the layer.

8. The method according to claim 7, wherein the S—(Ni, Fe)OOH layer is hydrophilic and contributes to release of gas bubbles during electrolysis.

9. The method according to claim 1, wherein dissolving amounts of $Fe(NO_3)_3 \cdot 9H_2O$ and $Na_2S_2O_3 \cdot 5H_2O$ in deionized water at ambient temperature includes dissolving 0.1x-0.5x grams of $Fe(NO_3)_3 \cdot 9H_2O$ and 0.02x-0.3x grams of $Na_2S_2O_3 \cdot 5H_2O$ in 10x mL of deionized water, for a value x.

* * * * *